US006427335B1

(12) United States Patent
Ralph

(10) Patent No.: US 6,427,335 B1
(45) Date of Patent: Aug. 6, 2002

(54) FOLDING KNIFE WITH OPEN POSITION LOCK

(75) Inventor: Darrel Ralph, Galena, OH (US)

(73) Assignee: Camillus Cutlery Company, Camillus, NY (US)

( * ) Notice: Subject to any disclaimer, the term of this patent is extended or adjusted under 35 U.S.C. 154(b) by 0 days.

(21) Appl. No.: 09/756,043

(22) Filed: Jan. 8, 2001

(51) Int. Cl.[7] ..... B26B 1/04
(52) U.S. Cl. ..... 30/161; 30/160
(58) Field of Search ..... 30/160, 161, 158; 7/118–120

(56) References Cited

U.S. PATENT DOCUMENTS

| | | | | | |
|---|---|---|---|---|---|
| 557,818 | A | | 4/1896 | Hotchkiss | |
| 727,724 | A | | 5/1903 | Weil | |
| 2,188,762 | A | | 1/1940 | Schrade | |
| 2,617,187 | A | | 11/1952 | Hopta | |
| 3,868,774 | A | | 3/1975 | Miori | |
| 4,502,221 | A | | 3/1985 | Pittman | |
| 4,612,706 | A | | 9/1986 | Yunes | |
| 4,660,284 | A | * | 4/1987 | Decarolis | 30/161 |
| 4,811,486 | A | | 3/1989 | Cunningham | |
| 4,926,554 | A | | 5/1990 | Martin | |
| 4,947,552 | A | * | 8/1990 | Barnes | 30/161 |
| 4,974,323 | A | | 12/1990 | Cassady | |
| 5,325,588 | A | | 7/1994 | Rogers | |
| 5,442,855 | A | | 8/1995 | Jobin | |
| 5,461,786 | A | | 10/1995 | Miller | |
| 5,495,674 | A | | 3/1996 | Taylor, Jr. | |
| 5,596,808 | A | | 1/1997 | Lake et al. | |
| 5,737,841 | A | | 4/1998 | McHenry et al. | |
| 5,755,035 | A | | 5/1998 | Weatherly | |
| 5,822,866 | A | | 10/1998 | Pardue | |
| 5,875,552 | A | | 3/1999 | Chen | |
| 6,267,063 | B1 | * | 8/2001 | Chen | 30/161 |

FOREIGN PATENT DOCUMENTS

| | | | | |
|---|---|---|---|---|
| IT | 639239 | * | 5/1962 | 30/160 |

* cited by examiner

*Primary Examiner*—Douglas D. Watts
(74) *Attorney, Agent, or Firm*—George R. McGuire; Hancock & Estabrook, LLP

(57) ABSTRACT

A folding knife having a locking member which is moved by a plunger and coil spring into a locking position, engaging a shoulder on the tang portion of a blade to prevent pivotal movement of the blade away from the fully open position. The locking member is pivotally mounted at one end in a recess in one of the handle members and extends across the cavity between the members to a manually engageable end in a through opening in the other handle member.

11 Claims, 3 Drawing Sheets

FOLDING KNIFE WITH OPEN POSITION LOCK

BACKGROUND OF THE INVENTION

The present invention relates to knives having one or more blades pivotally movable between open and closed positions, and more particularly to novel structure for retaining a folding knife blade in the open position until manually released.

In one form of so-called pocket knives, the blade or blades are movable about a pivot pin between open and closed positions with respect to a handle piece. In the fully open position the blade(s) extend substantially linearly from the handle, and in the closed position at least a portion including a sharpened edge is positioned in a space provided for such purpose between two portions of the handle. The open position of the blade(s) is usually defined by engagement of a locking surface (e.g., a shoulder or notch) formed in the blade with stationary structure on or connected to the handle. In order to ensure that the blade does not move from the fully open toward the closed position inadvertently, as when pressure is applied to the back of the blade while in use, it has been a common practice to provide folding knives with a so-called "lock-back" feature. The prior art includes lock-back structures which require manipulation by the user both for activating and deactivating the locking feature, as well as those which operate automatically, as by spring bias, upon movement of the blade to the open position. It is with the latter type of lock-back mechanism with which the present invention is concerned.

The object of the invention is to provide a folding blade knife having novel and improved structure which is automatically operable upon movement of the blade(s) to the fully open position to prevent movement away from such position, and which is quickly and easily manually manipulated to permit movement from open to closed position when desired.

Other objects will in part be obvious and will in part appear hereinafter.

SUMMARY OF THE INVENTION

In the disclosed embodiment, the knife of the invention has but a single blade although it will be immediately recognized and understood that a plurality of blades, tools, or the like, each movable between fully open and closed positions with respect to a handle piece, may be provided within the scope of the invention. The disclosed blade has a sharpened edge and a back, blunt edge. The blade has the usual tang portion at its proximal end, and is supported by a pivot pin passing through the tang and anchored in spaced portions of the handle piece. Each of the two handle portions includes a liner and a cover piece. A locking arm is pivotally mounted by a pin in one of the cover pieces and extends through a slot in the adjacent liner, across the space between the two liners, through a slot in the other liner and terminates at a manually engageable head in a slot in the other cover piece.

A plunger and spring are positioned in a recess in the other cover piece facing the adjacent liner. The plunger urges the locking arm toward rotation to a position wherein the portion of the arm spanning the space between the two cover portions blocks movement of the blade tang in the direction in which it must move to close the blade. That is, when the blade is in its fully open position the locking arm is moved, by the spring biased force of the plunger, to a position directly in the path in which the tang must be moved in order to move the blade away from the open position, thus preventing inadvertent, closing movement of the blade with possible injury to the user. When it is desired to close the blade, the head on the locking arm is moved within its slot to pivot the arm away from its blocking position against the spring bias.

The foregoing and other features of construction and operation of the lock-back structure of the invention will be more readily understood and fully appreciated from the following detailed disclosure, taken in conjunction with the accompanying drawing.

DETAILED DESCRIPTION

Figure 1:
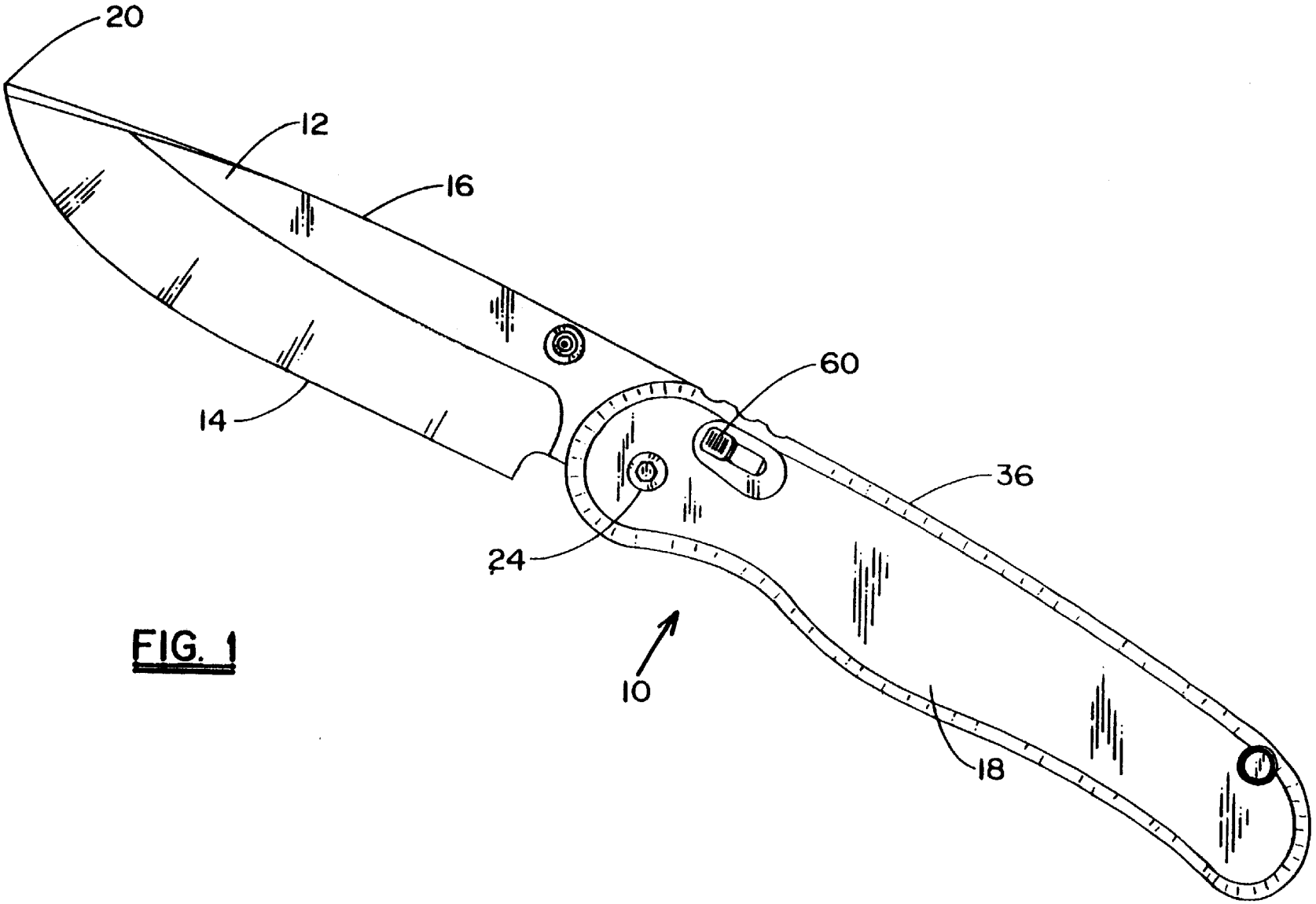
FIG. 1 is an elevational view of a folding knife embodying the invention.
Figure 3:
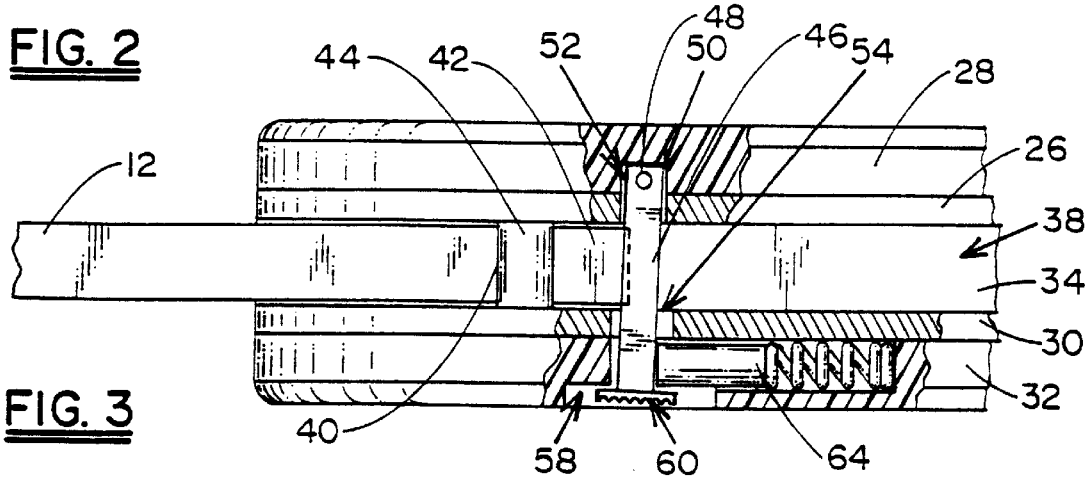
FIGS. 3 and 4 are enlarged, fragmentary, plan views of substantially the same portions of the knife as those shown in FIG. 2 with certain movable elements in two, terminal positions of movement.
Figure 4:
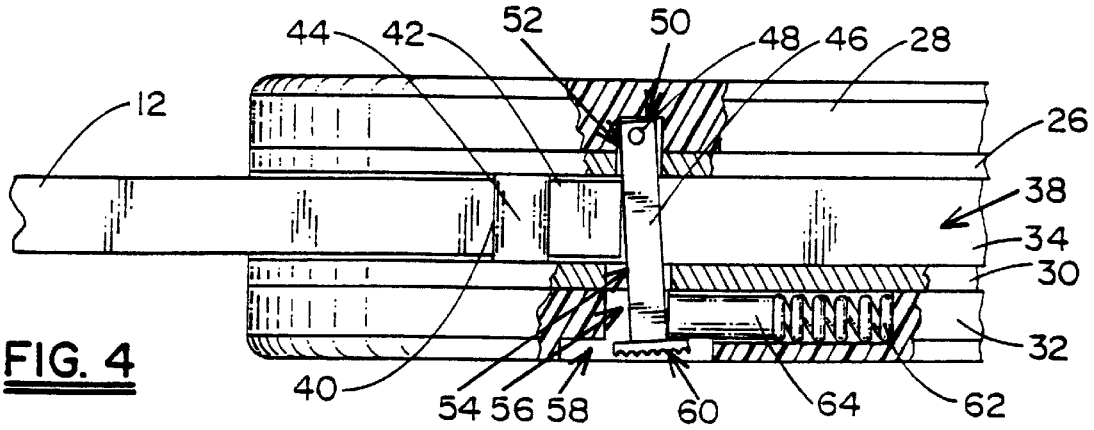

Knife 10 includes blade 12, having sharpened and blunt edges 14 and 16, respectively, and handle 18. Blade 12 has pointed, distal end 20 and conventional tang portion 22 at its proximal end. Pivot pin 24 passes through tang 22 and is anchored in spaced portions of handle 18 in conventional fashion for pivotal movement of blade 12 between a closed position, wherein portions of the blade including edge 14 are positioned between the two handle portions, and an open position illustrated in FIG. 1. As seen in FIGS. 3 and 4, each handle portions includes a liner and a cover piece, normally of metal and plastic, respectively, the liner and cover piece of one portion being denoted by reference numerals 26 and 28, respectively, and those of the other portion by numerals 30 and 32. Opposing surfaces of liners 26 and 30 are maintained in spaced, parallel relation by spacer member 34, extending along back 36 of knife 10, defining cavity 38 wherein tang 22 is mounted and wherein a portion of blade 12 is positioned when in the closed position.

Figure 2:
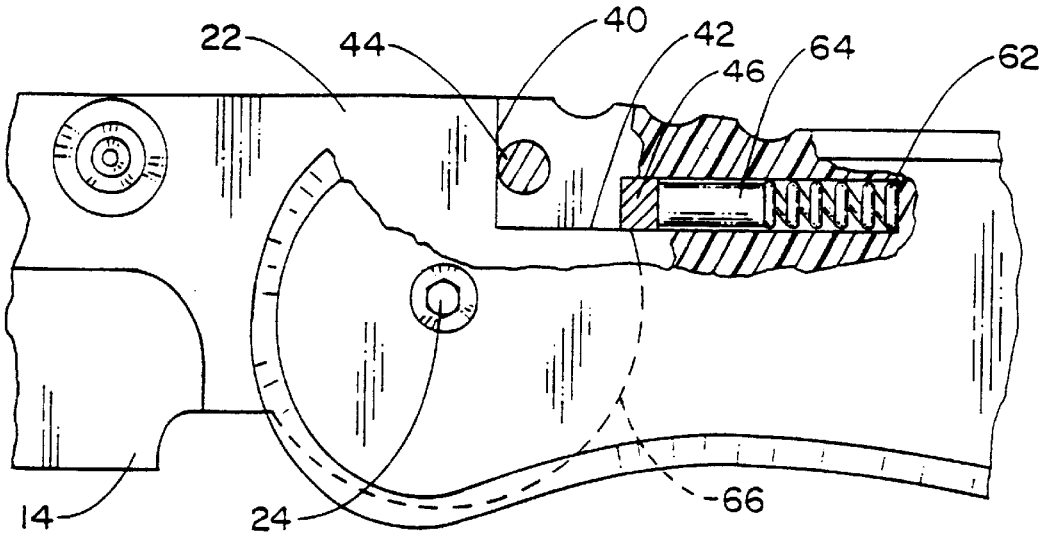
FIG. 2 is an enlarged, fragmentary, elevational view of a portion of the knife of FIG. 1 with portions broken away.

As best seen in FIG. 2, tang 22 includes a 90 degree notch, forming shoulders 40 and 42. Stop pin 44 extends across cavity 38 and is anchored in the two handle portions. The fully open position of blade 12 is defined by contact of shoulder 40 with stop pin 44, as seen in FIG. 2. Lock arm 46 is pivotally mounted by pin 48, extending through one end of aim 46 within recess 50 in cover piece 28, as seen in FIGS. 3 and 4. From its pivotally mounted end, lock arm 46 extends through open slot 52 in liner 26, across cavity 38, through open slot 54 in liner 30, through recess 56 in cover piece 32 and into open slot 58 where it terminates in head portion 60. Recess 56 communicates with slot 58, providing a through opening in cover piece 32 over a portion of recess 56, and the remainder of the recess is bounded on one side by liner 30, providing an enclosed chamber wherein a spring 62 and plunger 64 are mounted.

One end of spring 62 bears against one end of plunger 64, the other end of which bears against lock arm 46, biasing the latter toward rotation about pin 48 in a clockwise direction, in the orientation shown in FIGS. 3 and 4. Lock arm 46 contacts rounded portion 66 of tang 22 in all positions of blade 12 except the fully open position. When the blade reaches the fully open position, arm 46 is moved to the left, as seen in FIG. 2, by spring 62 and plunger 64. In this position, the portion of arm 46 spanning cavity 38 engages over shoulder 42, thereby locking blade 12 in the open position, defined by contact of shoulder 40 with pin 44 and shoulder 42 with arm 46. In order to moe blade 12 to the folded or closed position, the user must engage head 60 with a thumb or finger and move it from the position of FIG. 3 to that of FIG. 4. Locking arm 46 is thereby moved away from engagement with shoulder 42, permitting rotation of the blade away from the fully open, to the closed position.

Figure 5:
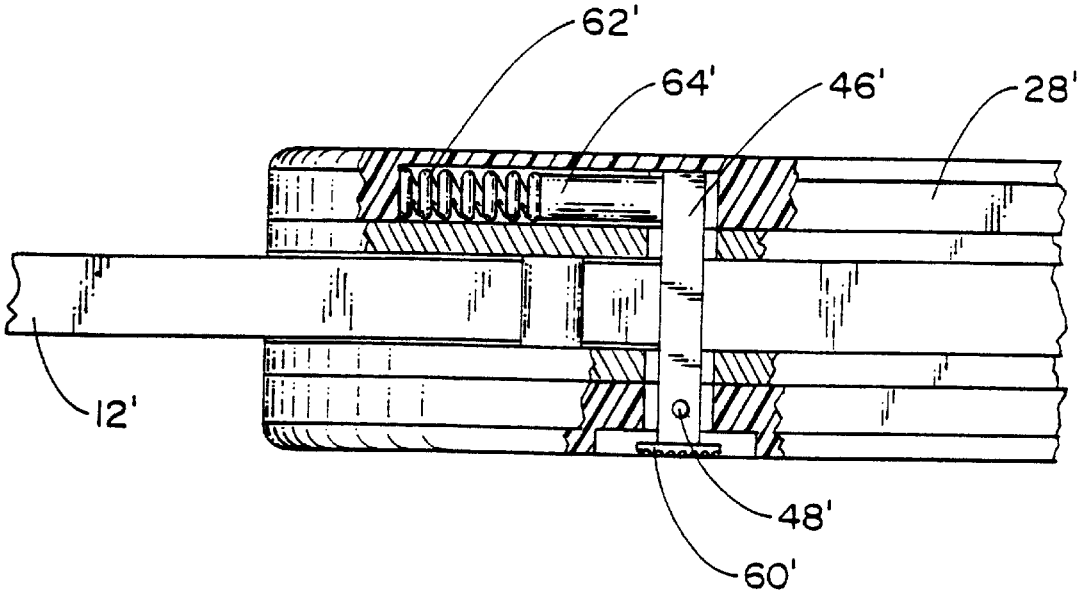
FIG. 5 is an enlarged, fragmentary plan view of an alternate embodiment of the movable elements illustrated in FIGS. 3 and 4.

Referring to FIG. 5, an alternate embodiment having the spring/plunger arrangement and pivot pin reversed from the principal embodiment is illustrated. Specifically, pivot pin 48' extends through lock arm 46', adjacent head portion 60', and spring 62' and plunger 64' are mounted within a chamber formed within cover piece 28' and bear against the end of lock arm 48' opposite head portion 60'. The result of this alternate embodiment is the same as with the principal embodiment with the exception being that slightly more user force is required to disengage lock arm 48' from blade 12'.

What is claimed is:

1. A folding knife comprising:

a) at least one blade, or the like, having a tang portion with a predetermined outer periphery at one end;

b) an elongated handle portion including a pair of members having spaced, parallel, opposed surfaces defining a cavity extending along the length of said handle portion;

c) a pivot pin extending through said tang portion and anchored in said handle portion for pivotal movement of said blade about said pivot pin between a closed position, wherein at least a portion of said blade is disposed within said cavity, and a fully open position, wherein said blade extends outwardly from said handle portion;

d) a fixed stop member on said handle portion;

e) a first shoulder on said tang portion for engagement with said stop member to define said fully open position of said blade;

f) a second shoulder on said tang portion;

g) a locking member having first and second ends, pivotally mounted at said first end upon one of said members and extending across said cavity into a through opening in the other of said members for reciprocal movement about said first end between a locking position, wherein said locking member engages said second shoulder to prevent movement of said blade away from said fully open position, and an unlocking position, wherein said locking member is out of the path of movement of any part of said tang portion to permit movement of said blade from said fully open to said closed position; and h) a spring biased plunger urging said locking member toward said locked position and moving said locking member to said locked position upon movement of said blade to said fully open position, said plunger being manually movable from said locked to said unlocked position.

2. The knife of claim 1, wherein said stop member comprises a stop pin extending across said cavity between said pair of handle members parallel to and laterally adjacent said pivot pin.

3. The knife of claim 1, and further including a plunger mounted in said through opening for linear movement parallel to said length of said handle, said plunger having one end contacting said locking member for movement thereof, and the other end contacting said spring.

4. The knife of claim 3, wherein said spring is a coil spring mounted in said through opening.

5. The knife of claim 1, wherein said handle portion has a back edge and said blade has a cutting edge and a back edge substantially linearly aligned with said handle back edge when said blade is in said fully open position.

6. The knife of claim 5, wherein said first shoulder is a linear edge of said tang portion extending from said predetermined periphery substantially perpendicular to said blade back edge.

7. The knife of claim 6, wherein said linear edge extends substantially radially with respect to said pivot pin.

8. The knife of claim 5, wherein said second shoulder is a linear edge of said tang portion extending from said predetermined periphery substantially parallel to said blade back edge.

9. The knife of claim 1, wherein said other end of said locking member terminates in a manually engageable button positioned in said through opening.

10. The knife of claim 9, wherein said one end of said locking member is pivotally mounted in a recess extending into said one of said handle members from said cavity defining surface thereof.

11. A folding knife with means for preventing inadvertent movement of a blade away from a fully open position, said knife comprising:

a) at least one blade having a cutting edge, a back edge, a point at one end and an integral tang portion at the other end;

b) an elongated handle portion including a pair of members having spaced, parallel, opposed surfaces defining a cavity open along a front side of said handle portion, and a spacer member closing said cavity along a back side of said handle portion;

c) a pivot pin extending through said tang portion and across said cavity and affixed at opposite ends to said pair of members for pivotal movement of said blade about said pivot pin between a closed position, wherein at least a portion of said blade is disposed within said cavity, and a fully open position, wherein said blade extends outwardly from said handle portion and said blade back edge and handle back side are substantially linearly aligned;

d) a stop pin extending across said cavity parallel to and laterally adjacent said pivot pin and affixed at opposite ends to said pair of members;

e) said tang portion having a first linear edge extending substantially perpendicular to said back edge for contact with said stop pin to define said fully open position of said blade, and a second linear edge extending substantially parallel to said back edge and intersecting said first linear edge;

f) a locking member having one end mounted within a first recess extending into said cavity defining surface of one of said handle members for pivotal movement between locking and unlocking positions about a first axis within said recess perpendicular to said back side, said locking member extending across said cavity to a manually engageable end positioned in a through opening in the other of said handle members;

g) a spring mounted in a second recess extending into said cavity defining surface of said other handle member and communicating with said through opening; and h) a plunger having one end contacting and compressing said spring within said second recess and the other end contacting said locking member within said through opening to urge said locking member toward said locking position, and moving said locking member to said locking position upon movement of said blade to said fully open position wherein said locking member engages said second linear edge to prevent rotation of said blade toward said closed position until said locking member is manually moved to said unlocking position.

* * * * *